US005981033A

United States Patent [19]

Haunschild et al.

[11] Patent Number: 5,981,033

[45] Date of Patent: Nov. 9, 1999

[54] PAVEMENT MARKING TAPE

[75] Inventors: Dale H. Haunschild, Hudson, Wis.; Neil A. Hodson, Bloomington, Minn.; Warren J. Johnson, Hudson, Wis.; Terrence W. Miller, Cottage Grove, Minn.; Larry K. Stump, Hudson, Wis.; James H. C. Harper, Hudson, Wis.; Roberta M. Collins Harper, Hudson, Wis.

[73] Assignee: 3M Innovative Properties Company, St. Paul, Minn.

[21] Appl. No.: 08/881,208

[22] Filed: Jun. 24, 1997

Related U.S. Application Data

[63] Continuation-in-part of application No. 08/815,523, Mar. 12, 1997, abandoned.

[51] Int. Cl.[6] ..... E01F 9/08

[52] U.S. Cl. ..... 428/182; 428/143; 428/181; 428/161; 428/162; 428/163; 428/149; 428/325; 404/14; 404/12

[58] Field of Search ..... 428/143, 182, 428/181, 161, 162, 163, 149, 325; 404/14, 12

[56] References Cited

U.S. PATENT DOCUMENTS

| | | | |
|---|---|---|---|
| 3,403,862 | 10/1968 | Dworjanyn | 239/566 |
| 3,915,771 | 10/1975 | Gatzke et al. | 156/71 |
| 3,949,128 | 4/1976 | Ostermeier | 428/152 |
| 4,299,874 | 11/1981 | Jones et al. | 428/143 |
| 4,443,510 | 4/1984 | Watt | 428/149 |
| 4,775,579 | 10/1988 | Hagy et al. | 428/284 |
| 4,965,117 | 10/1990 | Lautenschlaeger et al. | 428/182 |
| 4,965,122 | 10/1990 | Morman | 428/225 |
| 5,023,130 | 6/1991 | Simpson et al. | 428/227 |
| 5,151,320 | 9/1992 | Homonoff et al. | 428/284 |
| 5,180,621 | 1/1993 | Heier et al. | 428/138 |
| 5,194,113 | 3/1993 | Lasch et al. | 156/243 |
| 5,270,091 | 12/1993 | Krysiak et al. | 428/68 |
| 5,286,682 | 2/1994 | Jacobs et al. | 501/34 |
| 5,290,628 | 3/1994 | Lim et al. | 428/299 |
| 5,405,643 | 4/1995 | Scholz | 427/2.31 |
| 5,411,351 | 5/1995 | Lasch et al. | 404/14 |
| 5,453,320 | 9/1995 | Harper et al. | 428/356 |
| 5,498,232 | 3/1996 | Scholz | 602/8 |
| 5,536,569 | 7/1996 | Lasch | 428/328 |
| 5,539,033 | 7/1996 | Bredahl et al. | 525/270 |
| 5,679,437 | 10/1997 | Hackworth et al. | 428/143 |

FOREIGN PATENT DOCUMENTS

| | | | |
|---|---|---|---|
| 0 162 229 | 11/1985 | European Pat. Off. | E01F 9/08 |
| 0 453 135 | 10/1991 | European Pat. Off. | E01F 9/04 |
| WO 95/08426 | 3/1995 | WIPO | B29C 37/00 |
| WO 95/34264 | 12/1995 | WIPO | A61F 13/15 |
| WO 97/01676 | 1/1997 | WIPO | E01F 9/04 |
| WO 97/01677 | 1/1997 | WIPO | E01F 9/04 |

OTHER PUBLICATIONS

Brochure entitled "DuPont Nonwovens Sontara® Technologies—100% Polyester Fabrics" from DuPont; No. H–44557.

*Primary Examiner*—William P. Watkins, III
*Attorney, Agent, or Firm*—Peter L. Olson

[57] ABSTRACT

A pavement marking tape having a scrim, wherein the scrim is extensible to enable the tape to conform to irregularities in a road surface, and thereby bond more securely to that surface.

22 Claims, 2 Drawing Sheets

PAVEMENT MARKING TAPE

RELATED APPLICATION

This application is a continuation-in-part of the U.S. Ser. No. 08/815,523, abandoned filed Mar. 12, 1997.

TECHNICAL FIELD

The invention relates to removable pavement marking tape, and specifically to such a tape having a scrim to provide structural integrity.

BACKGROUND OF THE INVENTION

Pavement marking tapes are typically used to delineate the boundaries for lanes of traffic on a roadway. The tape may extend continuously, such as along the outermost boundaries of the driving lanes, or intermittently, such as between lanes. One popular use for such a tape is in construction work zones, where pavement marking tape can guide motorists through new traffic patterns without incident. Although these work zones may seem to remain in place for inordinately long periods of time, they eventually are removed and the pavement marking is removed from the roadway. To allow the pavement marking tape to be peeled from the surface of the roadway in a single piece, the marking tape must have sufficient structural integrity to prevent tearing. If the tape is intended to remain in place indefinitely, it is necessary to provide structural integrity sufficient to withstand the abuse that vehicles and weather can impose.

Various removable pavement marking tapes have been developed for uses such as that described above, and some such tapes include an integral scrim. An example of such a tape is the 3M Scotch-Lane™ Removable Tape sold by the Traffic Control Materials Division of Minnesota Mining and Manufacturing (3M) Company of St. Paul, Minn. under the designation 620. A simplified illustration of this type of conventional tape is provided in FIG. 1. Tape 10 includes a monolayer of glass beads 12 retained by binder layer 14, which is bonded to aluminum layer 16. Glass beads 12 provide retroreflectivity for the headlights of oncoming vehicles, and enable motorists to detect the pavement marking tape more easily than without such beads. Aluminum layer 16 provides deformability, which enables the tape to better adhere over imperfections in the surface of the road.

Beneath the aluminum layer 16 are adhesive layers 18 and 22, which permeate scrim 20 and bond it to the aluminum layer. Scrim 20 is typically a nonwoven sheet of natural staple fibers or synthetic melt-blown or spun-bonded polymeric fibers, or a composite. It may include a plurality of larger strands extending in the machine (longitudinal) direction, the transverse direction, or both to provide added strength and structural integrity. Scrim 20 exhibits good tensile strength, and thus is useful for peeling the tape 10 off road surface 24 to which it is adhesively bonded. The scrim also may help to prevent residual adhesive from remaining bonded to the road surface when the tape has been removed.

Although removable pavement marking tapes of the type described above are useful for many applications, they may exhibit certain disadvantages when applied to existing road surfaces. Those surfaces are usually irregular compared to new roads, and often exhibit topographical defects such as projections, impacted rocks or debris, dents, and the like. Although the aluminum layer alone is susceptible to inelastic deformation, and would otherwise enable the tape to be adhered to an irregular surface, the scrim is not. It is believed that the scrim can prevent this type of pavement marking tape from conforming to irregularities in the road surface, perhaps because the scrim increases the tendency of the tape to recover to its original shape (elasticity) after it has been deformed over a surface irregularity. When the tendency to recover exceeds the adhesive force attaching the tape to the surface, detachment occurs. Moreover, adhesion problems can be exacerbated by the presence of water on the road surface and under the tape which, in conjunction with freeze/thaw cycles, can accelerate the detachment process. Once the tape becomes partially or wholly detached from the road, the advantages offered by the tape, such as retroreflectivity, may no longer be obtained.

In view of these and other disadvantages of conventional pavement marking tapes, it is desirable to provide a pavement marking tape that effectively conforms to irregularities in a road surface and is easily removable in one piece.

SUMMARY OF THE INVENTION

The removable pavement marking tape of the present invention includes a durable upper portion including a surface presented for observation by a viewer, and an extensible scrim bonded to the underside of the upper portion to add structural integrity to the upper portion. In one embodiment, the extensible scrim is corrugated, and the corrugations are preferably microcorrugations. The scrim is preferably a nonwoven web. The extensible scrim exhibits controlled elongation, and because the elongation forces increase non-linearly (relatively low forces at low strain; relatively higher forces at high strain), it requires only a small amount of force to conform the pavement marking tape to an irregular road surface. The tape, however, retains sufficient structural integrity and tensile strength to enable the tape to be removed from the road in one piece.

DESCRIPTION OF THE DRAWINGS

The present invention is described with reference to the appended drawings, in which like numbers represent like structure throughout the several views, and wherein.

DETAILED DESCRIPTION OF THE INVENTION

The present invention is an improvement upon conventional removable pavement marking tapes of the type disclosed in, for example, U.S. Pat. Nos. 4,299,874 (Jones et al.), 5,194,113 (Lasch et al.), 5,286,682 (Jacobs et al.), 5,411,351 (Lasch et al.), and 5,536,569 (Lasch et al.), the entire disclosures of which are hereby incorporated by reference herein, and all of which are commonly assigned to the assignee of the present invention. Specifically, the improvement is in the scrim included within such a pavement marking tape. Thus, the descriptions provided herein as to other elements of the tape will be familiar to those of ordinary skill in the art.

Construction

Figure 1:
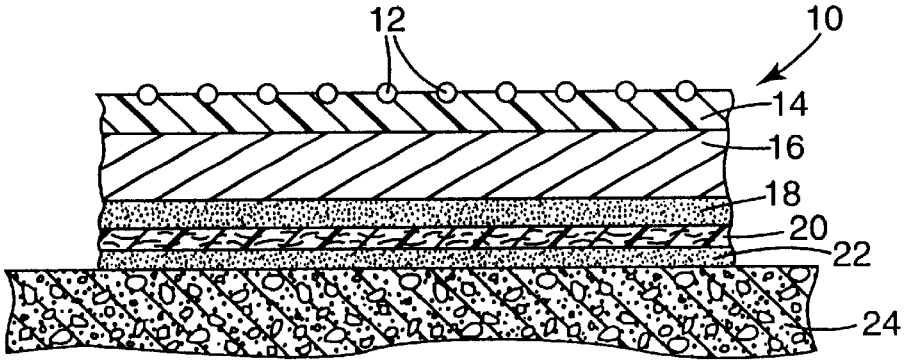
Fig. 1 PRIOR ART
FIG. 1 is a cross-sectional view of a conventional removable pavement marking tape having an integral scrim.
Figure 2:
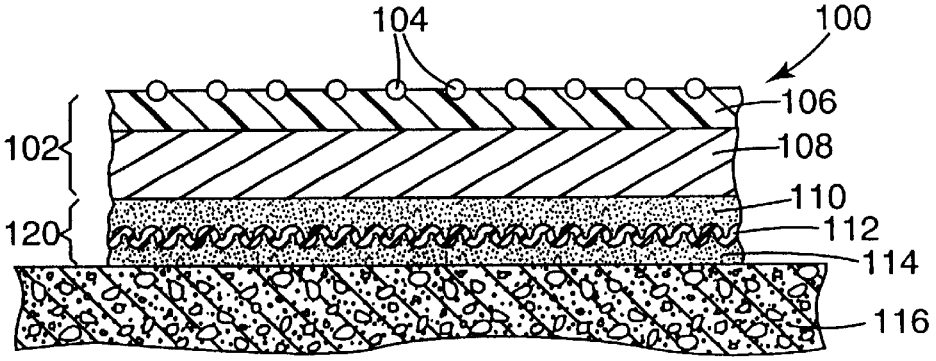
FIG. 2 is a cross-sectional view of a removable pavement marking tape having a corrugated scrim according to the present invention.
Figure 3:
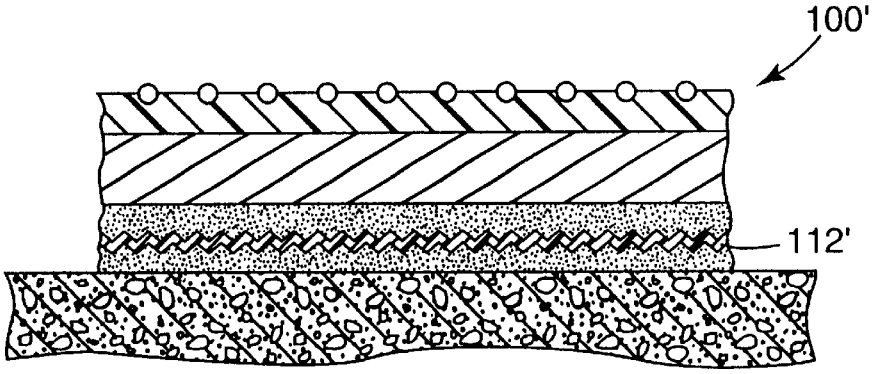
FIG. 3 is a cross-sectional view of a second embodiment of a pavement marking tape having a corrugated scrim according to the present invention.

FIG. 2 illustrates a cross-sectional view of one embodiment of a removable pavement marking tape 100 in accordance with the present invention. Tape 100 includes upper portion 102 and scrim portion 120.

Upper Portion: Upper portion 102 includes, in the illustrated embodiment, a monolayer of glass microspheres 104, binder layer 106, and conformable layer 108. However, any or all of these layers may be omitted and replaced with other layers, depending on the application for which the tape is intended. For example, upper layer 102 may include simply a durable colored polymeric layer. If they are used, the glass microspheres may be approximately 25 to 2000 micrometers in diameter, more preferably less than 1000 micrometers, and most preferably between 200 and 800 micrometers, and dispersed randomly across the tape. Alternatively, sand particles of a suitable size could be used to provide traction if the tape is used to mark pedestrian areas. The upper portion of the pavement marking tape typically includes a monolayer of glass beads adapted to retroreflect light projected thereupon by the headlights of a vehicle. Such beads (or other retroreflective means) are not necessary, however, if the visible surface of the upper portion is only to be colored or white.

Binder layer 106 preferably is a polymeric layer that bonds with and retains the glass microspheres or anti-skid particles, or both. As disclosed in U.S. Pat. No. 5,536,569 (Lasch et al.), an upper portion which is suitable for high visibility marking and carrying of reflecting elements and skid-resistant particles may also be formed of thermoplastic material. Preferred thermoplastic materials include ethylene acrylic acid (EAA) copolymers and ethylene methacrylic acid (EMAA) copolymers, and mixtures of EAA and EMAA; as well as ionically cross-linked EMAA. Preferably, the exposed top layer includes a visibility enhancing pigment such as titanium dioxide.

A preferred source of material for forming the upper portion includes the EMAA polymers, particularly the Nucrel brand resins available from the E.I. Dupont de Nemours and Company (Dupont) of Wilmington, Del. Other ethylene copolymers that may be used include ethylene acrylic acid (EAA), ionically cross-linked ethylene methacrylic acid (EMAA) ionomers (such as the Surlyn brand ionomers available from Dupont), ethylene n-butyl acrylate (EnBA), and ethylene vinyl acetate (EVA) and blends thereof Suitable polyolefins may also be used without a conformance layer. The typical thickness of such a layer would be 80 to 250 micrometers. Acid containing ethylene copolymers, such as EMAA polymers (the Nucrel products described above), are the preferred olefins for such marking sheets.

Conformable layer 108 is preferably metallic, and more preferably aluminum. U.S. Pat. No. 5,536,569 (Lasch et al.) discusses comformability generally. The conformable layer is preferably on the order of 0.076 mm (0.003 inches) thick, and extends across the width and along the length of the tape. Other suitable materials for conformable layer 108 include pliant polymeric materials such as nitrile rubber and the like, as described in U.S. Pat. No. 4,299,874 (Jones).

Another construction of the upper portion could include materials used to provide good retroreflectivity under rainy, wet conditions, such as those disclosed in PCT Publication WO 97/01677 (Bacon et al.). In that reference, the disclosure of which is incorporated by reference herein, the upper portion comprises an enclosed-lens retroreflective sheet that comprises a monolayer of retroreflective elements wherein first portions of the monolayer are arranged in an upwardly contoured profile and second portions of the monolayer are arranged in a lower, substantially planar position. Another useful upper layer is of the type described in PCT Publication WO 97/01676 (Bailey et al.), the disclosure of which is incorporated by reference herein. That reference describes a retroreflective article having good high entrance angle retroreflective properties provided by a monolayer of glass beads within the article, and good low entrance angle retroreflective properties provided by a series of approximately hemispherical protuberances formed on the top surface of the sheeting.

Scrim Portion: Scrim portion 120 includes, in the embodiment shown in FIG. 2, adhesive layers 110 and 112, and extensible scrim 112. Although the present invention is discussed primarily in terms of including a corrugated extensible scrim, the extensible scrim is not required to be corrugated, as described in greater detail below. Because scrim 112 is preferably a porous nonwoven (or nonwoven/woven composite) web, the two illustrated adhesive layers may actually be a single layer that merely permeates the scrim and bonds the upper surface of the scrim to the upper portion 102, and the lower surface of the scrim to the road or other surface. The adhesive used to bond the scrim portion to the upper portion preferably has a higher shear strength than the adhesive used to bond the tape to a surface, so that the tape remains intact when it is removed from the surface.

A preferred adhesive is a polybutadiene-based adhesive with tackifiers, such as adhesives available from 3M Company under the designations PM 7701, PM 7712, and PM 8001, the first two of which are described in U.S. Pat. No. 4,299,874 (Jones et al.), and the last of which is described in U.S. Pat. No. 5,539,033 (Bredahl et al.). Rubber-based adhesives include those having a low glass transition temperature of between about −120 degrees C. and about −50 degrees C. Illustrative examples of suitable elastomers include the following: natural rubber, polyisoprene, polybutadiene, styrene butadiene, polyisobutylene, butyl rubber, and A-B-A block copolymers wherein B represents a rubbery midblock having a glass transition temperature within the range indicated above (such as polyisoprene, polybutadiene, or poly(ethylene/butalene), and A represents a thermoplastic polystyrene end block. These may be used singly or in combination. Other adhesives may include non-polar acrylates and blends thereof, polar acrylates, and ionic cross-linked acrylates.

Figure 4:
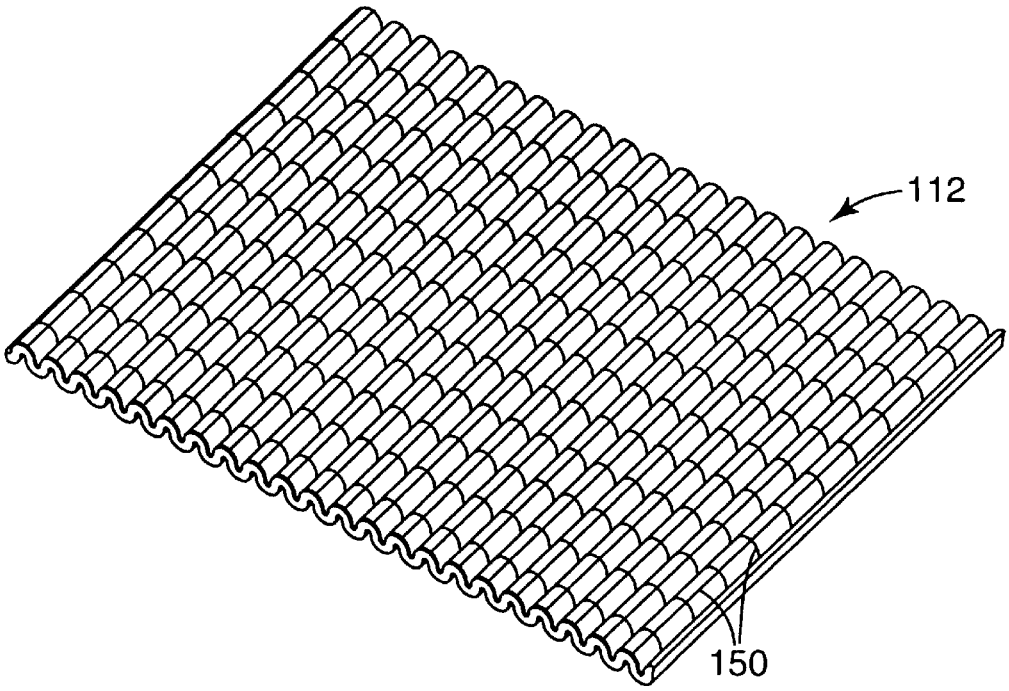
FIG. 4 is a perspective view of a corrugated scrim according to the present invention.

Scrim 112 is preferably a nonwoven thermoplastic web of the type shown in FIG. 4. The scrim is extensible, meaning that it is inelastically deformable, to better conform to the topography of the road, but still retains sufficient tensile strength after extension to permit the pavement marking tape to be removed from the road. Extensible scrims may be extensible along one or more axes (in the cross-web and down-web directions, for example), and may for convenience be referred to as uniaxially, biaxially, or omniaxially extensible. Extensible scrims may be made or purchased in a number of forms. Two popular types are hydroentangled webs and needletacked webs. Hydroentangled webs are described generally in U.S. Pat. No. 3,403,862 (Dworjanyn), which is incorporated by reference herein, and they are made by mechanically entangling individual fibers using one or more high pressure water jets that propel the fibers against a screen. Needletacked webs also have mechanically entangled fibers, but the fibers are entangled by barbed needles that pass through the fibers, and then pull some underlying fibers up through the remaining fibers. Other types of webs, including carded webs, rando webs, spunbonded webs, and meltblown webs, may also be useful if they are extensible, although some webs may lack sufficient strength to be useful in a pavement marking tape without additional processing to impart such strength. Extensible webs, as noted above, may be extensible along one or more axes, and are preferably biaxially or omnidirectionally extensible to permit the greatest degree of conformance to an irregular surface. These scrims typically weigh between 17 and 102 g/m$^2$ (0.5 and 3.0 oz/yd$^2$), and preferably between about 51 and 85 g/m$^2$ (1.5 and 2.5 oz/yd$^2$). The tensile strength should be sufficient to permit subsequent removal of the pavement marking tape, which is typically at least 1785 g/cm width (10 lbs/inch width) in the longitudinal direction when measured at a rate of 30 cm/minute (12 in/minute).

Two preferred extensible scrims are available from Dupont Nonwovens of Wilmington, Del. under the designation SONTARA™, and more specifically under product numbers 8005 and 8021. These hydroentangled webs are made of 100% polyester, and have basis weights of 68 and 81 g/m$^2$, respectively, and thicknesses of 0.65 and 0.78 mm, respectively.

In the embodiment in which corrugations provide extensibility, the sheet of scrim material has been processed or treated to provide a series of peaks and valleys. This enables more scrim material to occupy the same area than would an uncorrugated scrim, which in turn provides the tape in which the scrim is incorporated to demonstrate increased conformance to irregular surfaces. The corrugations may be either regular and uniform, or irregular and nonuniform. For example, the corrugations may be approximately linear folds formed in the scrim that extend across the width of the scrim or along its length. Alternatively, the corrugations may, due to processing conditions, appear to be discrete peaks and associated valleys distributed across the surface of the scrim to provide the same effect. One preferred method of providing such corrugations will be described below, but it will be apparent to persons of skill in the art that many variations on the corrugated scrim described herein are possible. For example, although the corrugations shown are generally illustrated as extending across the scrim transversely, other orientations (or no orientation, in the case of discrete peaks) may be used instead.

U.S. Pat. Nos. 5,498,232 (Scholz) and 5,405,643 (Scholz) describe the crimping or "microcreping" of fabrics for orthopedic casting tapes. Crimping and microcreping provide extensible, corrugated materials of the type described herein, and microcreping refers specifically to the process used to mechanically compact a fabric so that it has a smaller lengthwise dimension than it originally had. Thus, it is desirable to use a scrim material that comprises fibers which are capable of first being mechanically compacted or "creped," and then being set, annealed, or otherwise maintained in substantially the distorted shape. For example, the adhesive used to bond the scrim to the upper portion may maintain the corrugated scrim in its distorted form.

Figure 5:
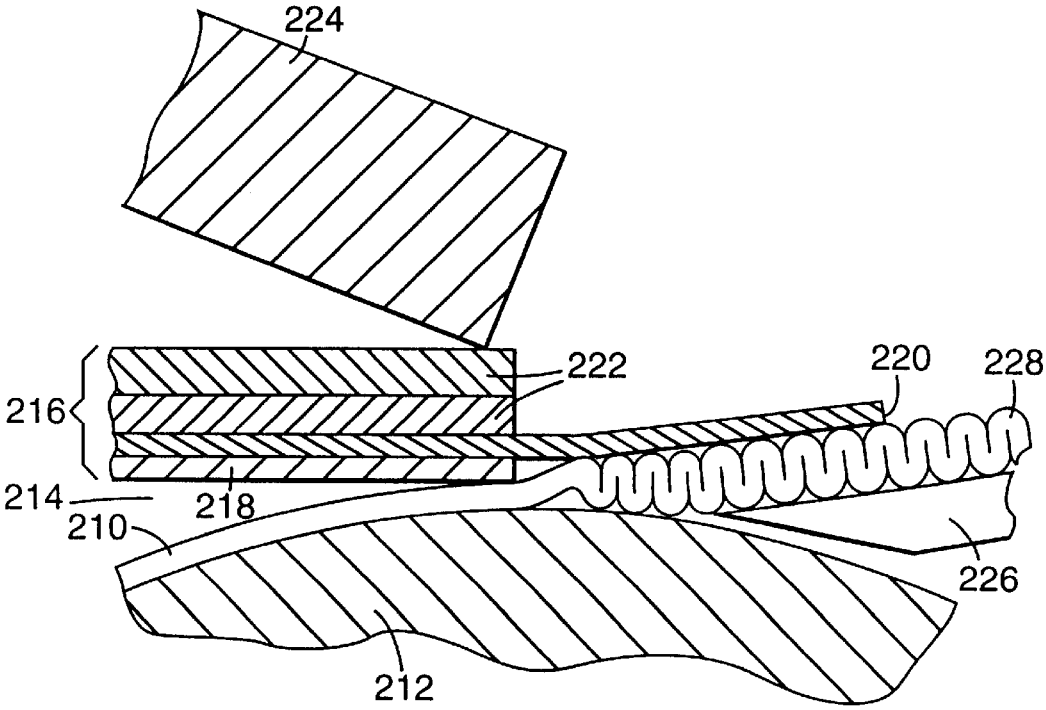
FIG. 5 is a schematic diagram of an apparatus for making a microcreped corrugated scrim according to the present invention.

The Scholz patents, which are incorporated by reference herein, include descriptions of a process believed to be suitable for preparing a corrugated scrim in accordance with the present invention. That process, commercialized by the Micrex Corporation of Walpole, Mass., will be referred to as the "Micrex process" and is described with reference to FIG. 5. Untreated web 210, supported by main roll 212, is introduced into a converging passage 214 between the main roll and a movable retarder 216. The movable retarder has a primary surface 218, a flexible retarder 220, and one or more back-up blades 222. The movable retarder is held against the untreated web using a pressure plate 224. The web passes through a secondary passage between the flexible retarder and a rigid retarder 226 and exists as a corrugated, microcreped web 228. The extent of microcreping need not be uniform across the width of the web. Patterns, if desired, may be formed by differential compaction delivered by properly designed retarders. Variations on this Micrex process are described in the Scholz patents, and will be apparent to those of skill in the art. For example, a scrim may be corrugated by being passed between rollers, at least one of which has peaks (discrete, continuous, or both) formed therein to provide valleys in the scrim. It should be noted that if sufficient tensile force is applied to a corrugated scrim, it may lose the corrugated effect, and thus the conformance effect that is important to the operation of the invention.

As shown in FIG. 4, the scrim may also be provided with reinforcing fibers 150 extending longitudinally, transversely, or both, as shown. The fibers may be made from the same material or a different material as the remainder of the scrim, and in a preferred embodiment are made from a thermoplastic polymer. The reinforcing fibers may be bonded to each other at points where they intersect by, for example, a heating or calendering process. Although the reinforcing fibers are shown as being parallel to each other and extending approximately parallel to the edges of the scrim, they need not be either. In one embodiment, the reinforcing fibers are bonded to the nonwoven web before the web is corrugated, and more specifically the fibers are laminated to the reinforcing fibers to form the composite scrim. Two examples of such a scrim are those available from the Bayex Division of Bay Mills Limited, of St. Catharines, Ontario, Canada under the designation BQX 3311P4RR and BQV 5510P4RR.

Another way to form the scrim portion is to provide a netting of reinforcing fibers and to melt-blow, spun-bond, or laminate (either by heat or adhesive, or both) nonwoven fibers to the netting. For example, the netting may include a grid of intersecting cords of 500 or 1000 denier and openings measuring 0.93 cm (0.37 in) square, and a web of nonwoven fibers may be adhesively or thermally laminated to the netting, or both. The web may be bonded to one or both sides of the netting.

Conformance

The marking tape upper layer should be conformable, meaning that it conforms to irregularities in the surface to which the tape is attached. As described in U.S. Pat. No. 5,194,113, incorporated herein by reference above, conformable marking tapes should be capable of being deformed under reasonable forces in order to take on the shape of the road surface irregularities, and thereby allow formation of a good bond to the road surface. By reasonable forces it is meant that after applying the marking sheet to a road surface and tamping it, the marking tape conforms to the road surface. In such an application, the tamped tape substantially replicates the surface texture of the road.

Conformability of a marking tape may be evaluated in several ways. One simple way is to press a layer or sheet of the material by hand against a complex, rough, or textured surface such as a concrete block or asphalt composite pavement, remove the sheet, and observe the degree to which the surface has been replicated in the sheet. Another assessment of the conformance of a marking tape may be obtained as follows. First, the force required to deform the sheet material a suitable amount is measured. Second, a portion of the induced strain is relieved. Finally, the retractive force remaining in the material at the reduced strain level is measured. A specific example of this process would be to deform a sample to 115% of its original length by stretching the sample at a strain rate of 0.05 $sec^{-1}$ and measuring the stress at 115% deformation, release the strain at the same rate, allow the material to return to 110% of its original length, and measure the retractive force. This measurement may be made using a standard tensile testing apparatus such as, for example, the servohydraulic tensile testers available from MTS Systems Corporation of Minneapolis, Minnesota. Preferred comformable materials exhibit a force to deform the sample to 115% of its original length of less than 35 NT per cm width (20 lbs per inch width), and a retractive force at a subsequent 110% deformation of less than 14 NT per cm width (8 lbs per inch width), although lesser forces are even more preferred. Other measures of conformability are described in U.S. Pat. No. 5,194,113, and may also be used in conjunction with the pavement marking tapes of the present invention to evaluate conformance of a sheet material to an irregular surface.

The conformance of a scrim obtained from the Bayex Division of Bay Mills Limited, of St. Catharines, Ontario, Canada under the designation BQX3311P4RR was tested as described above both initially and after microcreping at several levels of compaction using the "Micrex process" and the results are tabulated below:

| BQX3311P4RR | Stress @ 115% Strain | Stress when relaxed to 110% Strain |
|---|---|---|
| No Compaction | | |
| Longitudinal Direction | 6606 g/cm (36.95 lbs/in) | 429 g/cm (2.399 lbs/in) |
| Crossweb Direction | 3814 g/cm (21.333 lbs/in) | 34.9 g/cm (0.195 lbs/in) |
| 85% Compaction | | |
| Longitudinal Direction | 268 g/cm (1.5 lbs/in) | 23.4 g/cm (0.131 lbs/in) |
| Crossweb Direction | 4523 g/cm (25.3 lbs/in) | 64.9 g/cm (0.363 lbs/in) |
| 70% Compaction | | |
| Longitudinal Direction | 53.6 g/cm (0.300 lbs/in) | 17.7 g/cm (0.099 lbs/in) |
| Crossweb Direction | 4943 g/cm (27.65 lbs/in) | 70.4 g/cm (0.394 lbs/in) |

These compacted webs are believed to be suitable in the present invention because they require a low force (less than 3570 g/cm (20 lbs/inch)) to deform at 115% strain in the longitudinal direction. The ultimate tensile strength of the materials at break were also measured in the longitudinal direction and the following results were obtained:

| | |
|---|---|
| BQX3311P4RR with no compaction | 366 g/cm (42.050 lbs/in) @ 17% strain |
| BQX3311P4RR with 85% Compaction | 5572 g/cm (31.167 lbs/in) @ 49% strain |
| BQX3311P4RR with 70% Compaction | 4559 g/cm (25.500 lbs/in) @ 77.5% strain |

The conformance of the SONTARA™ 8005 and 8021 hydroentangled polyester webs previously described were also tested as described above, with the following results:

| | Stress @ 115% Strain | Stress when relaxed to 110% Strain |
|---|---|---|
| SONTARA™ 8005 | | |
| Longitudinal Direction | 2770 g/cm (15.53 lbs/in) | 20 g/cm (0.112 lbs/in) |
| Crossweb Direction | 59 g/cm (0.33 lbs/in) | 1.1 g/cm (0.006 lbs/in) |
| SONTARA™ 8021 | | |
| Longitudinal direction | 2520 g/cm (14.13 lbs/in) | 3.8 g/cm (0.021 lbs/in) |

-continued

| | Stress @ 115% Strain | Stress when relaxed to 110% Strain |
|---|---|---|
| Crossweb direction | 143 g/cm (0.80 lbs/in) | 4.5 g/cm (0.025 lbs/in) |

These webs are believed to be particularly suitable in the present invention because they require a low force (less than 3570 g/cm (20 lbs/inch)) to deform at 115% strain in both the longitudinal and the crossweb directions. The ultimate tensile strength of the materials at break were also measured in the longitudinal direction and the following results were obtained:

| | |
|---|---|
| SONTARA™ 8005 | 4980 g/cm (27.9 lbs/in) @ 28% Strain |
| SONTARA™ 8021 | 4980 g/cm (27.9 lbs/in) @ 30% Strain |

The corrugations provided in the scrim, when used in conjunction with other layers of the tape having acceptable conformance characteristics, enable the tape to inelastically conform to surface irregularities and to resist recovery. This is believed to be true because the corrugations in the scrim provide additional scrim material to accommodate the additional surface area of the road created by depressions or protuberances in the road surface. The scrim thus "wraps" the irregularities, and because it is not in tension, tends to remain wrapped over the irregularities. This is beneficial because it increases adhesion of the pavement marking tape to the road surface, while at the same time providing sufficient structural integrity to the tape to permit a person to peel it from the road surface without tearing.

In another embodiment, the conformance layer could be strengthened and corrugated and the scrim portion omitted from the construction. The conformance layer would then have to provide sufficient strength and integrity to permit it to remain together when the pavement marking tape is peeled from a surface. This construction would probably be less expensive and thinner than the other constructions described herein because it does not include the scrim portion or the adhesive layer used to bond the scrim portion to the upper portion.

It should be noted that the various layers may be put in different locations within the tape, such that the conformance layer may underlie the scrim, for example, as disclosed in PCT Publication WO 95/08426 (Rice et al.), the disclosure of which is incorporated by reference herein.

Manufacture: The removable pavement marking tape of the invention may be manufactured substantially as described in U.S. Pat. No. 5,194,113 (Lasch et al.) incorporated by reference above, except for the fact that the corrugated or otherwise extensible scrim is substituted for the conventional scrim described in that reference. Briefly, the extensible scrim is saturated with adhesive and then laminated to the upper layer which, as described above, may include glass beads, a binder layer, and a conformable layer.

Suggestive Examples

The following suggestive examples illustrate combinations of materials believed to be useful in constructing a pavement marking tape in accordance with the present invention. For simplicity, the components of the invention (upper portion, adhesives, extensible scrim) may be selected from among those listed.

Upper portions: Suitable upper portions include (1) the 620 Scotch-Lane pavement marking tape available from 3M, which includes a 0.076 mm (0.003 in) thick aluminum conformance layer; (2) the wet retroreflective marking material described in PCT Publication WO 97/01677; and (3) the retroreflective article having good high entrance angle and good low entrance angle retroreflective performance described in PCT Publication WO 97/01677.

Extensible Scrim: Suitable extensible scrims include corrugated scrims such as (1) a Bayex 3311 scrim, which includes 0.93 cm (0.37 in) square netting of 1000 denier cords having a nonwoven web laminated to each side of the netting using a binder, and corrugated using the Micrex process; and (2) a Bayex 5510 scrim, which includes 0.51 cm (0.2 in) square netting of 500 denier cords having a nonwoven web laminated to each side of the netting using a binder, and corrugated using the Micrex process, and other extensible scrims such as hydroentangled polyester webs available from Dupont Nonwovens of Wilmington, Del. under the designation SONTARA™, and more specifically under product numbers 8005 and 8021.

Adhesives: Suitable adhesives include (1) a solvent-based polybutadiene adhesive with tackifier; and (2) a 100% solid polybutadiene adhesive. As noted previously the bond strength between the upper portion and the scrim should exceed the bond strength between the tape and a surface to which the tape is attached.

Although the present invention has been described with reference to several embodiments thereof, persons of ordinary skill in the art will recognize that many variations from the embodiments disclosed are possible. Accordingly, the scope of the present invention is not restricted to the disclosed embodiments, but only to those structures recited in the following claims.

We claim:

1. A pavement marking tape, comprising:

(a) a durable upper portion including a surface presented for observation by a viewer; and (b) an extensible, corrugated scrim bonded to the underside of the upper portion.

2. The pavement marking tape of claim 1, wherein a layer of adhesive is bonded to the scrim so that the tape may be applied to the surface of a roadway.

3. The pavement marking tape of claim 1, wherein the upper portion includes a binder layer in which a layer of transparent beads is held, the beads adapted to retroreflect incident light.

4. The pavement marking tape of claim 3, wherein the binder layer includes urethane.

5. The pavement marking tape of claim 1, wherein the upper portion includes a conformable aluminum layer.

6. The pavement marking tape of claim 1, wherein the upper portion includes a pliant polymeric conformance layer.

7. The pavement marking tape of claim 6, wherein the polymeric conformance layer includes nitrile rubber.

8. The pavement marking tape of claim 1, wherein the corrugations are irregular.

9. The pavement marking tape of claim 8, wherein the corrugations are microcorrugations.

10. The pavement marking tape of claim 1, wherein the scrim is a nonwoven blown microfiber web.

11. The pavement marking tape of claim 1, wherein the scrim further includes a plurality of reinforcing fibers having a larger diameter than fibers making up the remainder of the scrim.

12. The pavement marking tape of claim 11, wherein the scrim includes a set of substantially longitudinal reinforcing fibers and a set of substantially transverse reinforcing fibers.

13. The pavement marking tape of claim 1, wherein the tape comprises sequential layers of glass beads, a urethane layer, an extensible scrim, and an adhesive for bonding the tape to a surface.

14. A pavement marking tape, comprising:

(a) a durable upper portion including a surface presented for observation by a viewer;

(b) a scrim bonded to the underside of the upper portion; and (c) corrugations formed in the scrim for providing additional scrim material to inelastically wrap irregularities in a surface to which the tape is applied.

15. A method of making a pavement marking tape, comprising the steps of:

(a) providing a durable upper portion including a surface presented for observation by a viewer;

(b) providing an extensible, corrugated scrim; and (c) bonding the extensible scrim to the upper portion.

16. The method of claim 15, wherein step (b) further comprises the step of providing microcorrugations in the scrim.

17. The method of claim 15, wherein step (b) further comprises providing corrugations in an extensible nonwoven web.

18. The method of claim 17, wherein the nonwoven web is melt blown or spun bonded.

19. The method of claim 15, wherein the method includes a step (d) comprising saturating the extensible scrim with adhesive.

20. The method of claim 19, wherein the method comprises the steps of saturating the scrim with urethane, applying adhesive to one side of the scrim, and applying glass beads to the other side of the scrim.

21. The method of claim 15, wherein step (b) comprises providing a netting including reinforcing fibers, and bonding fibers to at least one side of the netting to provide a scrim.

22. The method of claim 21, wherein the step of bonding fibers to at least one side of the netting includes laminating a web of nonwoven polymeric fibers to the netting.

* * * * *

UNITED STATES PATENT AND TRADEMARK OFFICE

CERTIFICATE OF CORRECTION

PATENT NO. : 5,981,033
DATED : November 9, 1999
INVENTOR(S) : Haunschild, Dale H.

It is certified that error appears in the above-identified patent and that said Letters Patent is hereby corrected as shown below:

Title page,
Item [56], U.S. PATENT DOCUMENTS, delete
"5,536,569 7/1996 Lasch" and insert in place thereof
-- 5,536,569 7/1996 Lasch et al. --.

Column 3,
Line 48, delete "thereof Suitable" and insert in place thereof -- thereof. Suitable --.

Signed and Sealed this

Seventh Day of October, 2003

JAMES E. ROGAN
*Director of the United States Patent and Trademark Office*